US009733053B2

(12) United States Patent
Olroyd

(10) Patent No.: US 9,733,053 B2
(45) Date of Patent: Aug. 15, 2017

(54) FLEXIBLE AMMUNITION HOLDERS

(71) Applicant: Craig Olroyd, Santa Barbara, CA (US)

(72) Inventor: Craig Olroyd, Santa Barbara, CA (US)

( * ) Notice: Subject to any disclaimer, the term of this patent is extended or adjusted under 35 U.S.C. 154(b) by 0 days.

(21) Appl. No.: 15/133,468

(22) Filed: Apr. 20, 2016

(65) Prior Publication Data

US 2016/0313105 A1 Oct. 27, 2016

Related U.S. Application Data

(60) Provisional application No. 62/150,723, filed on Apr. 21, 2015.

(51) Int. Cl.
*F42B 39/02* (2006.01)

(52) U.S. Cl.
CPC ..... *F42B 39/02* (2013.01)

(58) Field of Classification Search
CPC ..... F42B 39/02; F42B 39/26; Y10S 224/931; A45F 2200/0591; A45F 5/02
See application file for complete search history.

(56) References Cited

U.S. PATENT DOCUMENTS 1,482,491 A * 2/1924 Vogel ..... F42B 39/02 224/247
2,372,685 A 4/1945 Schaich
3,190,514 A * 6/1965 Spilman ..... F42B 39/02 206/3
3,248,007 A * 4/1966 Hulterstrum ..... F42B 39/002 221/116
3,744,170 A * 7/1973 Jensen ..... F42B 39/02 42/87
3,777,954 A * 12/1973 Theodore ..... F42B 39/02 224/199
3,845,889 A 11/1974 Hurd
4,262,833 A * 4/1981 DeSantis ..... F42B 39/02 206/3
4,757,894 A * 7/1988 Schreckenstein ..... F42B 39/02 206/1.5
4,826,059 A 5/1989 Bosch
4,843,649 A 7/1989 Jewell
5,261,178 A 11/1993 Samish
5,924,613 A * 7/1999 Johnson ..... A45F 5/02 2/94
8,613,157 B2 12/2013 McCaffery
8,931,633 B2 * 1/2015 Martin, III ..... F41A 9/85 206/3
2005/0121485 A1 * 6/2005 Spicer ..... F42B 39/02 224/196
2006/0113347 A1 6/2006 Link
2010/0176174 A1 7/2010 Felts
2014/0103083 A1 * 4/2014 Sitz ..... F42B 39/08 224/255

(Continued)

*Primary Examiner* — Corey Skurdal
(74) *Attorney, Agent, or Firm* — Guy Cumberbatch

(57) ABSTRACT

A holder for ammunition and, in particular, to a flexible holder that conforms to curved surfaces especially useful for holding shotgun shells. The holder is a flexible band of separate ammunition shell or cartridge holders which enables the wearer to quickly and easily access the ammunition. The band may be attached to the wearer's arm, belt, or other conveniently accessed location. The band is molded in one piece in a sheet-like configuration and folded to form three-dimensional receptacles and belt loops.

20 Claims, 6 Drawing Sheets

(56) References Cited

U.S. PATENT DOCUMENTS

| | | | | |
|---|---|---|---|---|
| 2014/0124387 | A1* | 5/2014 | Iannello | F42B 39/02<br>206/3 |
| 2015/0090750 | A1* | 4/2015 | Coleman | F42B 39/02<br>224/222 |
| 2015/0292847 | A1 | 10/2015 | Sturm | |

* cited by examiner

FIG. 8
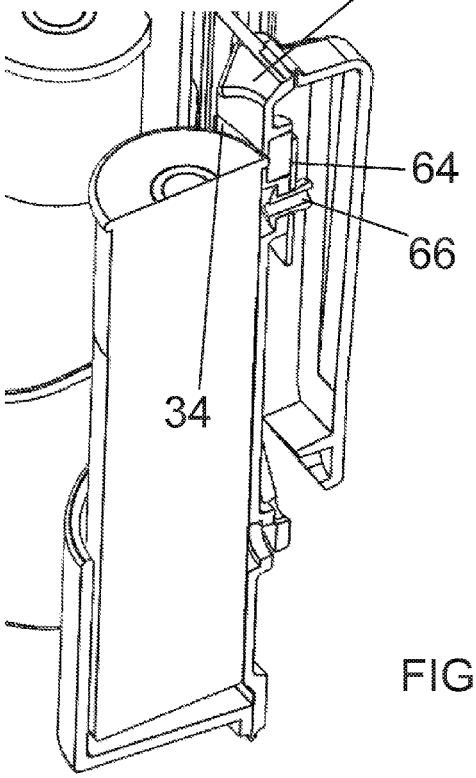
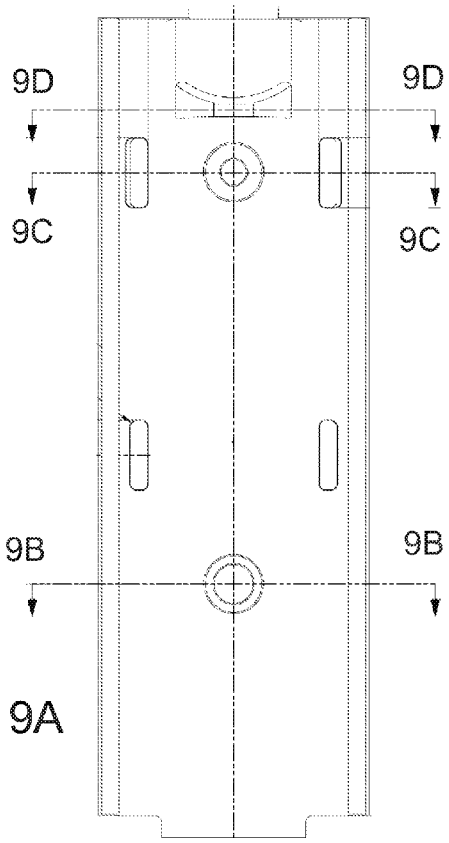
FIG. 9A
FIG. 9B
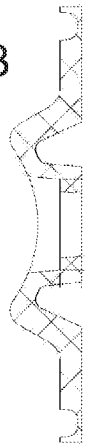
FIG. 9C
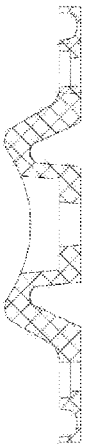
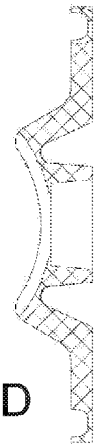
FIG. 9D

FLEXIBLE AMMUNITION HOLDERS

RELATED APPLICATIONS

The present application claims priority under 35 USC §119 to U.S. Provisional Ser. No. 62/150,723, filed Apr. 21, 2015.

FIELD OF THE INVENTION

The present invention is directed to a holder for ammunition and, in particular, to a flexible holder that conforms to curved surfaces especially useful for holding shotgun shells.

BACKGROUND OF THE INVENTION

Shotgun shooting for hunting or sport involves numerous variables. In particular, there are many types of shotgun shells available in terms of shot material and weight for the same bore of shotgun. Shells for grouse hunting may not work for hunting quail, and vice-versa. Some holders on the market mount to the shotgun itself, but these are somewhat hard to access and add to the weight of the gun.

Thus, there is a need for a more ergonomic and convenient holder for different types of shotgun shells.

SUMMARY OF THE INVENTION

The present application pertains to a flexible band of separate ammunition shell or cartridge holders which enables the wearer to quickly and easily access the ammunition. The band may be attached to the wearer's arm, belt, or other conveniently accessed location. The band is molded in one piece in a sheet-like configuration and folded to form three-dimensional receptacles and belt loops.

A flexible holder band for ammunition shells or cartridges is disclosed that conforms to curved surfaces. The holder band comprises a flexible band of separate ammunition shell or cartridge holders which enables the wearer to quickly and easily access the ammunition, wherein the band is a molded polymer in one piece in a sheet-like configuration and folded to form three-dimensional receptacles and belt loops. Each holder preferably comprises one of the receptacles for partially retaining one end of the shell or cartridge and a magnet outside of the retainer for securing an opposite end. A notch may be formed adjacent the magnet for receiving and retaining therein a rim of the shell or cartridge. The holders are particularly useful for holding shotgun shells.

A further understanding of the nature and advantages of the invention will become apparent by reference to the remaining portions of the specification and drawings.

BRIEF DESCRIPTION OF THE DRAWINGS

Features and advantages of the present invention will become appreciated as the same become better understood with reference to the specification, claims, and appended drawings wherein:

FIG. 8 is a partial sectional view of one of the holders taken through a shotgun shell held therein; and FIGS. 9A-9D are elevational and sectional views of a backing plate for the holders disclosed herein.

DETAILED DESCRIPTION OF THE PREFERRED EMBODIMENTS

The present invention is directed to a holder for ammunition and, in particular, to a flexible holder that conforms to curved surfaces especially useful for holding shotgun shells.

Figures 1, 2A, 2B:
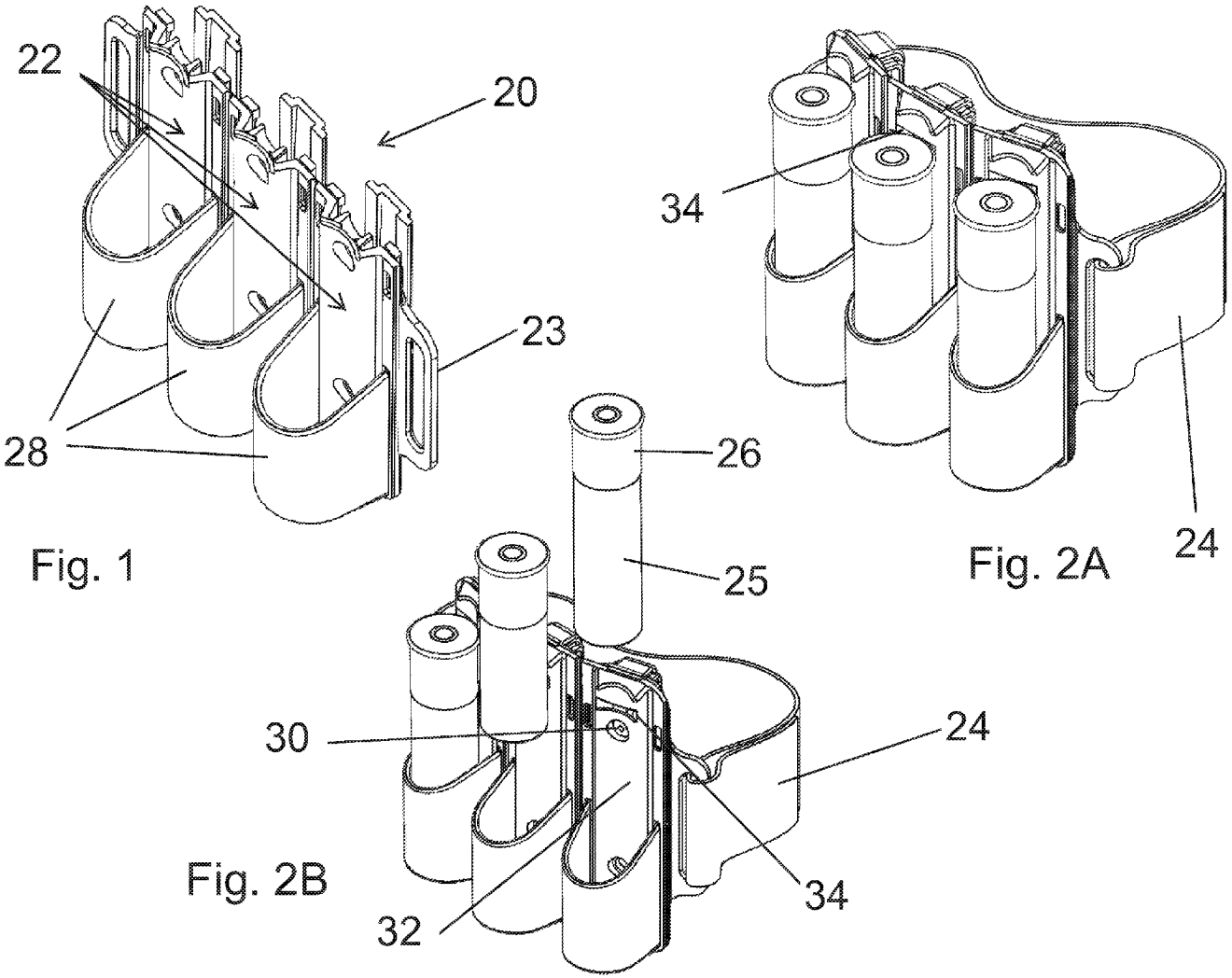
FIG. 1 is a perspective view of a band of ammunition holders of the present application.
FIG. 2A is a perspective view of the band of ammunition holders of Figure with shotgun shells held therein.
FIG. 2B is a perspective view showing removal of two of the shells from their respective holders.

FIG. 1 is a perspective view of an assembly in the form of a band 20 of ammunition holders 22 of the present application. The isometric view of the band 20 is shown without 3 shotgun shells in each of three separate holders. The band 20 preferably has flanges 23 on either lateral side with slots for receiving a strap or belt 24, as shown in FIGS. 2A and 2B. The band 20 of ammunition holders 22 may be held in various places on a person, such as the waist or on the arm, or can be secured to a rifle or other such equipment with the strap or belt 24.

FIG. 2A is a perspective view of the band of ammunition holders of FIG. 1 with shotgun shells held therein, and FIG. 2B is a perspective view showing removal of two of the shells from their respective holders. Shotgun shells normally include a cylindrical plastic case 25 containing shot and a powder charge and a metallic (typically brass) head 26. The cylindrical case 25 fits snugly within the holder 22 and small magnets 30 (e.g., Neodymium) hold the head 26 of the shell casing with a normal force.

For the purpose of orientation, a vertical or longitudinal direction corresponds to the axis of the cylindrical shotgun shell and each receptacle 28, while a horizontal or lateral direction is perpendicular thereto and extends across the series of holders 22. A depth or normal direction is orthogonal to both longitudinal and lateral.

The magnets 30 are preferably held in small apertures just behind an upper portion of a concave shaped brace 32 for each shell, adjacent to the metallic head 26 of the shells. The shells fit into lower receptacles 28 and a small horizontal notch 34 at an upper end of the braces 32 receives and retains a rim of each metallic head 26 in conjunction with the holding power of the magnets 30. The notch 34 provides a positive stop to the shells falling out of the holder 22 without someone pulling the top end with the metallic head 26 normally away from the magnet and out of the notch.

The concave curvature of the shaped braces 32 matches the shell diameters to secure the shells against vibration. The shaped braces 32 serve as structural stiffeners.

Figure 3:
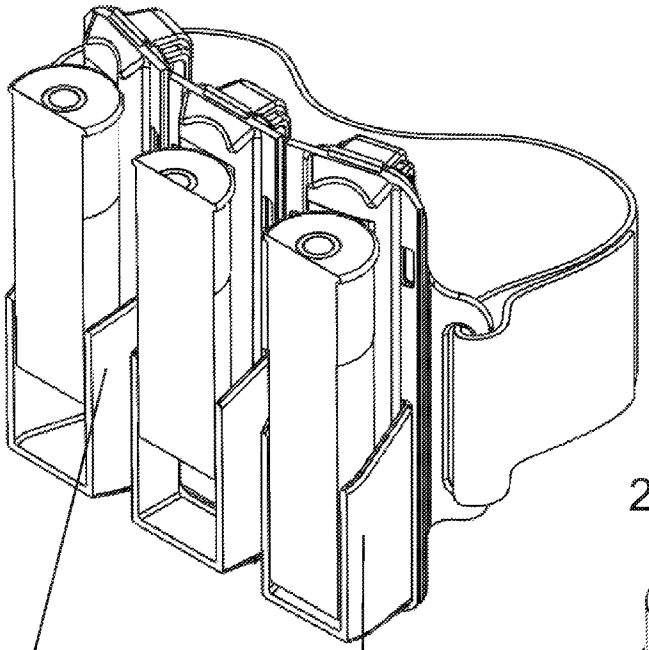
FIG. 3 is a partial sectional view of the band of ammunition holders of FIG. 2A taken through shotgun shells held therein.

FIG. 3 is a partial sectional view of the band 20 of ammunition holders 22 of FIG. 2A taken through different types of shotgun shells held therein. In this view, the first 2 shells are 2¾ inch long so that they don't extend all the way into the corresponding receptacles 28, and the 3$^{rd}$ shell is a 3½ inch magnum shell that reaches the bottom of the corresponding receptacle 28, showing that the ammunition holder accommodates all shell sizes.

Figure 4:
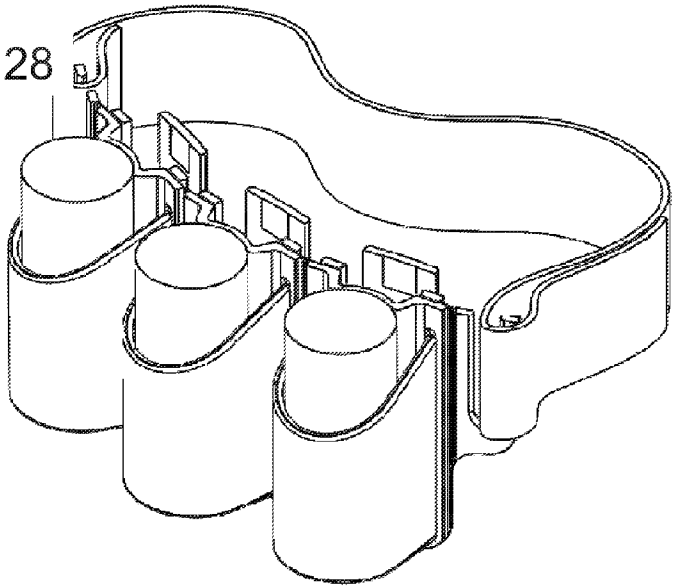
FIG. 4 is a perspective view of the band of ammunition holders with sectional view showing the fit of shotgun shells in the holder.

FIG. 4 is a perspective view of the band of ammunition holders showing the mating curvature of the shaped braces to the diameter of the shotgun shells.

Figure 5C:
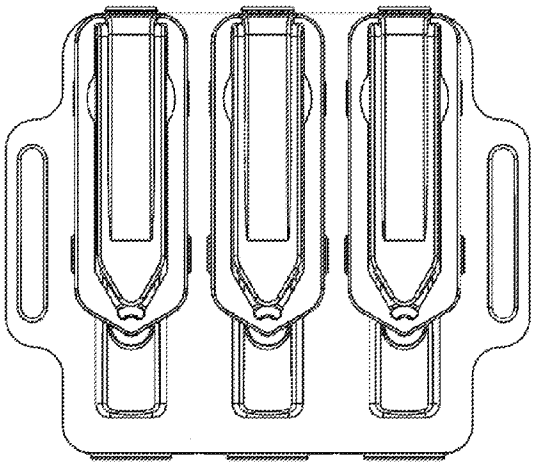
FIGS. 5A-5E are various orthogonal views of the band of ammunition holders of the present application shown assembled or folded.
Figure 5B:
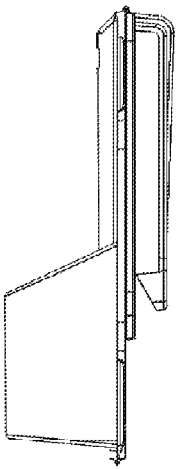
Figure 5A:
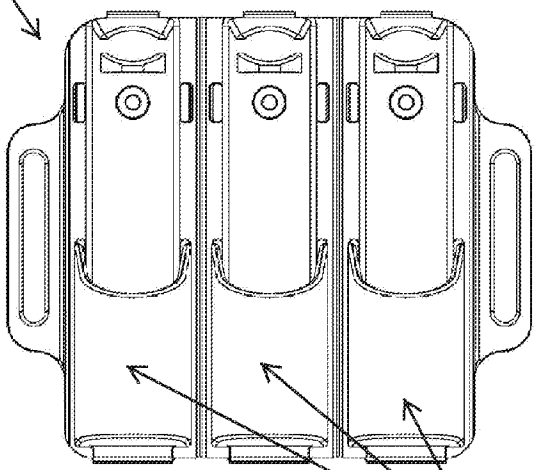
Figure 5D:
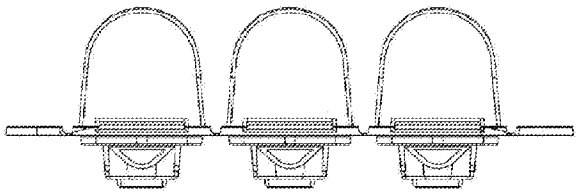
Figure 5E:
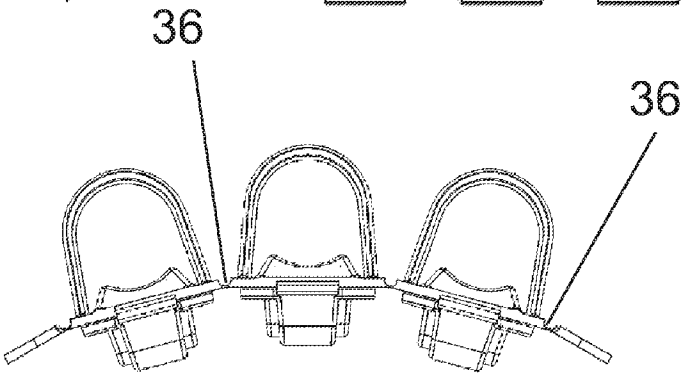
Figure 6:
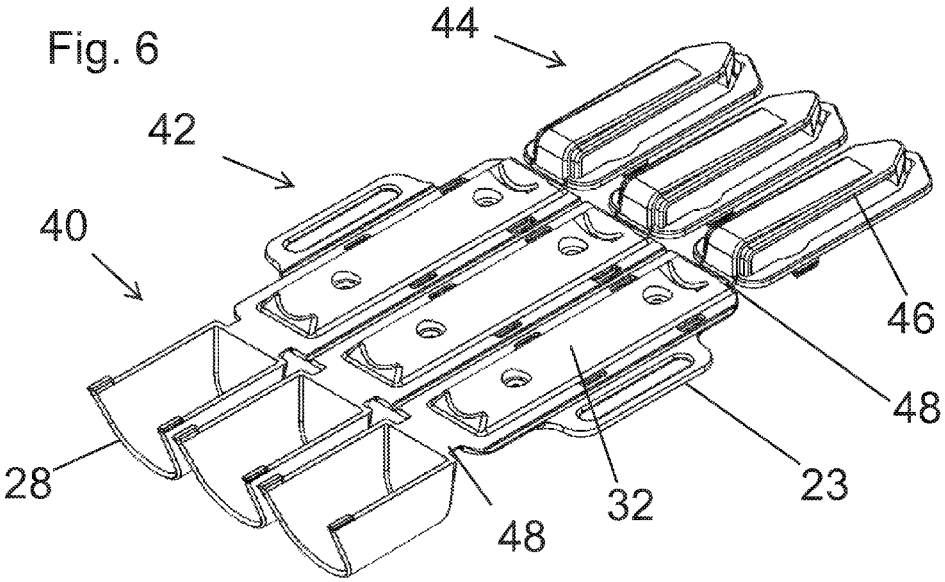
FIGS. 6 and 6A-6C are various orthogonal views of the band of ammunition holders of the present application shown disassembled or unfolded.
Figure 6A:
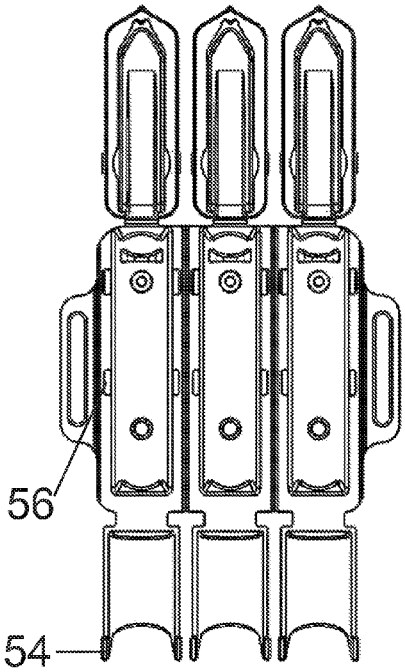
Figure 6B:
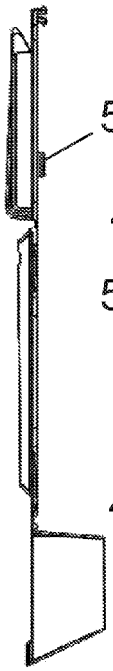
Figure 6C:
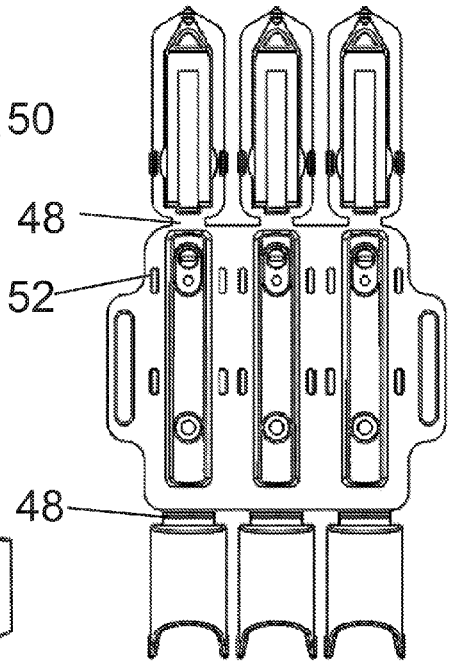
Figure 7:
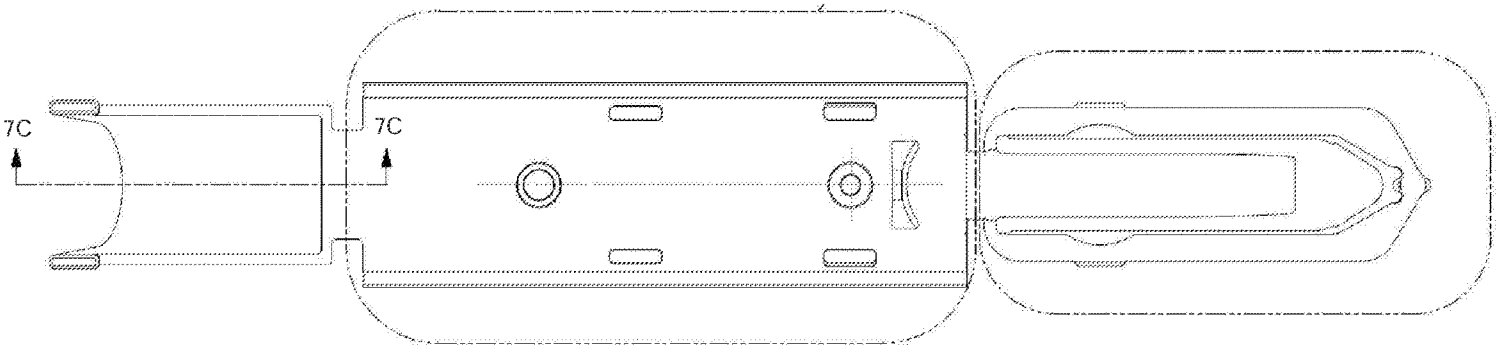
FIGS. 7 and 7A-7C are various orthogonal and sectional views of one of the ammunition holders.
Figure 7A:
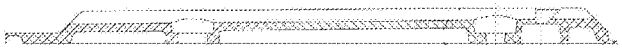
Figure 7B:
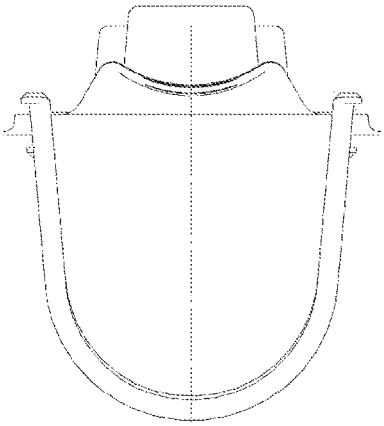
Figure 7C:
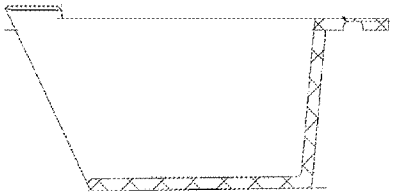

FIGS. 5A-5E are various orthogonal views of the band 20 of ammunition holders 22 of the present application shown assembled or folded. In FIG. 5E, living hinges 36 enable modular shell holders to "flex" to match the curvature of the shooter's arm or other curved object. Three holders 22 are shown for each band 20, though just one or more than three are of course contemplated.

FIGS. 6 and 6A-6C are various orthogonal views of the band of ammunition holders of the present application shown disassembled or unfolded. Preferably, the band 20 of holders 22 is formed as a single injection molded part to minimize cost and incorporates 3 sections for each holder 22 into one: a shell backing section 40 having the braces 32, a shell cup retainer section 42 defining the outer wall of the receptacles 28, and a belt loop/clip section 44 defining belt loop opening clips 46. Various laterally-oriented living hinges 48 allow flexing or folding of the sections 40, 42, 44 about lateral axes to facilitate assembly.

These three sections 40, 42, 44 are folded and assembled into the shape as seen in FIGS. 5A-5E using integrated snaps to provide a built-in assembly. For instance, positive snaps 50 on each belt loop/clip section 44 snap into small openings 52 formed in the central shell cup retainer section 42, and positive snaps 54 on each shell backing section 40 snap into small openings 56 also formed in the central shell cup retainer section 42. In this way, the assembled three-dimensional band 20 may be easily formed from an essentially planar or sheet-like configuration blank. Consequently, the blank is easily molded without resort to multi-part or movable molds.

Unfilled polypropylene is the preferred material to provide the necessary flexibility to enable live hinges 36 and 48 that flex without breaking and sufficient stiffness to retain structural integrity needed for the shell retaining features 28, belt loop 23 and clips 46.

The design includes large draft angles up to 5 degrees as required on the molded surfaces to enable the use of a coarse surface textures in the mold cavities. A coarse surface texture reduces glare that is important for camouflage purposes when hunting live game and aids in maintaining a grip on the part in cold and wet environments.

The belt loop opening clip 46 is design for up to 1.75×3/16 inch tactical belt used in shooting competitions. An offset design creates structural ribs to stiffen belt clips.

FIGS. 7 and 7A-7C are various orthogonal and sectional views of one of the ammunition holders 22 showing the cooperating parts in greater detail.

FIG. 8 is a partial sectional view of one of the holders taken through a shotgun shell held therein. FIG. 8 shows a 45° lead-in angle 60 just before the notch 34 that provides sufficient retention to prevent shell from vibrating loose while enabling effortless removal of the shell by the user. Preferably a metallic washer 64 is used to provide low cost retention of an annular magnet 30. A rivet 66 retains the washer 64 thus trapping the magnet 30 in a plastic counter bore.

FIGS. 9A-9D are elevation and sectional views of a backing plate for the holders disclosed herein.

Although the invention has been described and illustrated with a certain degree of particularity, it is understood that the present disclosure has been made only by way of example, and that numerous changes in the combination and arrangement of parts can be resorted to by those skilled in the art without departing from the scope of the invention, as hereinafter claimed.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A flexible holder band for ammunition shells or cartridges that conforms to curved surfaces, comprising:

a flexible band of separate ammunition shell or cartridge holders which enables the wearer to quickly and easily access the ammunition, wherein the band is a molded polymer in one piece in a sheet-like configuration and folded to form three-dimensional receptacles and belt loops, wherein the band in its sheet-like configuration includes three sections for each holder, including a longitudinally oriented central shell backing section, a shell cup retainer section defining an outer wall of the receptacle connected by a first hinge to a first longitudinal end of the central shell backing section, and a belt loop/clip section defining belt loops and connected by a second hinge to a second longitudinal end of the central shell backing section opposite the first longitudinal end, wherein the shell cup retainer section may be rotated 180° about the first hinge and secured to a front face of the central shell backing section to form the receptacle of the holder, and the belt loop/clip section may be rotated 180° about the second hinge and secured to a rear face of the central shell backing section to form the belt loop.

2. The flexible holder of claim 1, wherein the holder comprises one of the receptacles for partially retaining one end of the shell or cartridge and a magnet outside of the receptacle for securing an opposite end.

3. The flexible holder of claim 2, further including a notch formed adjacent the magnet for receiving and retaining therein a rim of the shell or cartridge.

4. The flexible holder of claim 1, wherein the shell or cartridge is a shotgun shell, and the receptacle has a tubular shape sized to closely receive a cylindrical plastic case of the shotgun shell.

5. The flexible holder of claim 1, wherein both the shell cup retainer section and the belt loop/clip section have small tabs formed thereon and are secured to respective faces of the central shell backing section by inserting the tabs into corresponding slots formed in the central shell backing section.

6. The flexible holder of claim 1, wherein the central shell backing section include a concave shaped brace that conforms to and helps retain a cylindrical outer contour of the ammunition shell or cartridge retained in the corresponding holder.

7. The flexible holder of claim 1, wherein the central shell backing section further includes a lateral notch formed in a longitudinal end opposite the first hinge for receiving and retaining therein a rim of the shell or cartridge.

8. A flexible holder band for ammunition shells or cartridges that conforms to curved surfaces, comprising a flexible band of separate ammunition shell or cartridge holders which enables the wearer to quickly and easily access the ammunition, wherein the band is formed in one piece in a sheet-like configuration that includes three sections for each holder, including a longitudinally oriented central shell backing section, a shell cup retainer section connected by a first hinge to a first longitudinal end of the central shell backing section, and a belt loop/clip section connected by a second hinge to a second longitudinal end of the central shell backing section opposite the first longitudinal end, wherein the shell cup retainer section may be rotated 180° about the first hinge and secured to a front face of the central shell backing section to form an outer wall of a receptacle of the holder, and the belt loop/clip section may be rotated 180° about the second hinge and secured to a rear face of the central shell backing section to form a belt loop/clip.

9. The flexible holder of claim 8, wherein the central shell backing section further includes a lateral notch formed in a longitudinal end opposite the first hinge for receiving and retaining therein a rim of the shell or cartridge.

10. The flexible holder of claim 9, further including a magnet held in the central shell backing section and aligned with the notch for helping to secure the rim of the shell or cartridge in the notch.

11. The flexible holder of claim 8, wherein the shell or cartridge is a shotgun shell, and the receptacle has a tubular shape sized to closely receive a cylindrical plastic case of the shotgun shell.

12. The flexible holder of claim 8, wherein the central shell backing section include a concave shaped brace that conforms to and helps retain a cylindrical outer contour of the ammunition shell or cartridge retained in the corresponding holder.

13. The flexible holder of claim 8, further including longitudinally oriented hinges on lateral sides of the central shell backing section so that adjacent holders are hinged together about longitudinal axes.

14. A flexible holder band for ammunition shells or cartridges that conforms to curved surfaces, comprising a flexible band of separate ammunition shell or cartridge holders which enables the wearer to quickly and easily access the ammunition, wherein the band is formed of a one piece molded polymer in a sheet-like configuration that includes at least two sections for each holder, including a longitudinally oriented central shell backing section and a shell cup retainer section connected by a first living hinge to a first longitudinal end of the central shell backing section, wherein the shell cup retainer section may be rotated 180° about the first hinge and secured to a front face of the central shell backing section to form an outer wall of a receptacle of the holder, the central shell backing section further including a lateral notch formed in a longitudinal end opposite the first hinge for receiving and retaining therein a rim of the shell or cartridge, and the band further including longitudinally oriented hinges on lateral sides of the central shell backing section so that adjacent holders are hinged together about longitudinal axes.

15. The flexible holder of claim 14, further including a magnet held in the central shell backing section and aligned with the notch for helping to secure the rim of the shell or cartridge in the notch.

16. The flexible holder of claim 15, wherein the magnet is held by a rivet on a rear face of the central shell backing section.

17. The flexible holder of claim 14, wherein the central shell backing section include a concave shaped brace that conforms to and helps retain a cylindrical outer contour of the ammunition shell or cartridge retained in the corresponding holder.

18. The flexible holder of claim 14, further including a belt loop/clip section connected by a second living hinge to a second longitudinal end of the central shell backing section opposite the first longitudinal end, belt loop/clip section may be rotated 180° about the second hinge and secured to a rear face of the central shell backing section to form a belt loop/clip.

19. The flexible holder of claim 18, wherein both the shell cup retainer section and the belt loop/clip section have small tabs formed thereon and are secured to respective faces of the central shell backing section by inserting the tabs into corresponding slots formed in the central shell backing section.

20. The flexible holder of claim 14, further including a pair of belt loops formed on the central shell backing sections of each of the holders that are on outer lateral ends of the band.

* * * * *